US005560733A

United States Patent [19]

Dickinson

[11] Patent Number: 5,560,733

[45] Date of Patent: Oct. 1, 1996

[54] GAS PRE-CHARGED MASS COUNTERBALANCING

[76] Inventor: Harry D. Dickinson, 1551 Melwood Dr., Glendale, Calif. 91207

[21] Appl. No.: 461,437

[22] Filed: Jun. 5, 1995

[51] Int. Cl.[6] ..... E01F 13/08

[52] U.S. Cl. ..... 404/6; 49/49; 49/131; 60/478; 14/71.7

[58] Field of Search ..... 404/6, 9, 11; 49/49, 49/131, 9, 33; 14/71.7; 60/477, 478

[56] References Cited

U.S. PATENT DOCUMENTS 4,490,068 12/1984 Dickinson ..... 49/49 X
4,818,136 4/1989 Nasatka et al. ..... 49/33 X
4,850,737 7/1989 Nasatka et al. ..... 60/477 X
4,861,185 8/1989 Eikelenboon ..... 404/6

*Primary Examiner*—Michael Powell Buiz
*Assistant Examiner*—James A. Lisehora
*Attorney, Agent, or Firm*—William H. Maxwell

[57] ABSTRACT

A system for above grade and below grade installation, for rendering the mass weightless in preparation to being lifted subject to its mass inertia, wherein a pre-charge is applied to the pneumatic end of a pressure accumulator at a pre-set pressure, and an adjustment made charging the other end of the accumulator with a working fluid for balancing the mass as required against gravity and with a volume of working fluid to ensure operation, the pre-set gas pressure being increased by the adjustment to apply a working pressure for counterbalancing the mass above and below its weight as required.

33 Claims, 5 Drawing Sheets

41
40
39
D
36
20
Y
X
24
33
GAS
32
34
35
22
21
26'
23
26
26"
38
LIQUID
37
43
42
Z
45

L
C1
C2
19
18
16
V1
V2
17
V3
V4
FR
E
B
S
R
AIR
A
M
C
REC.

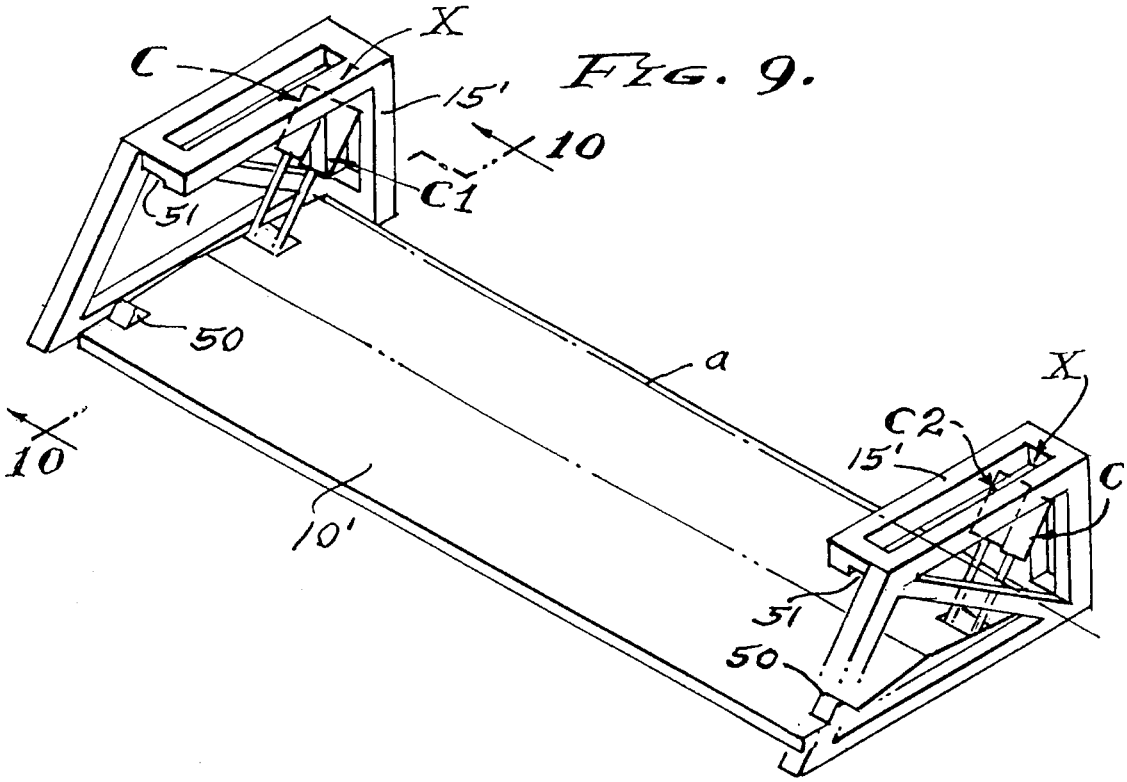
FIG. 9.
FIG. 10.
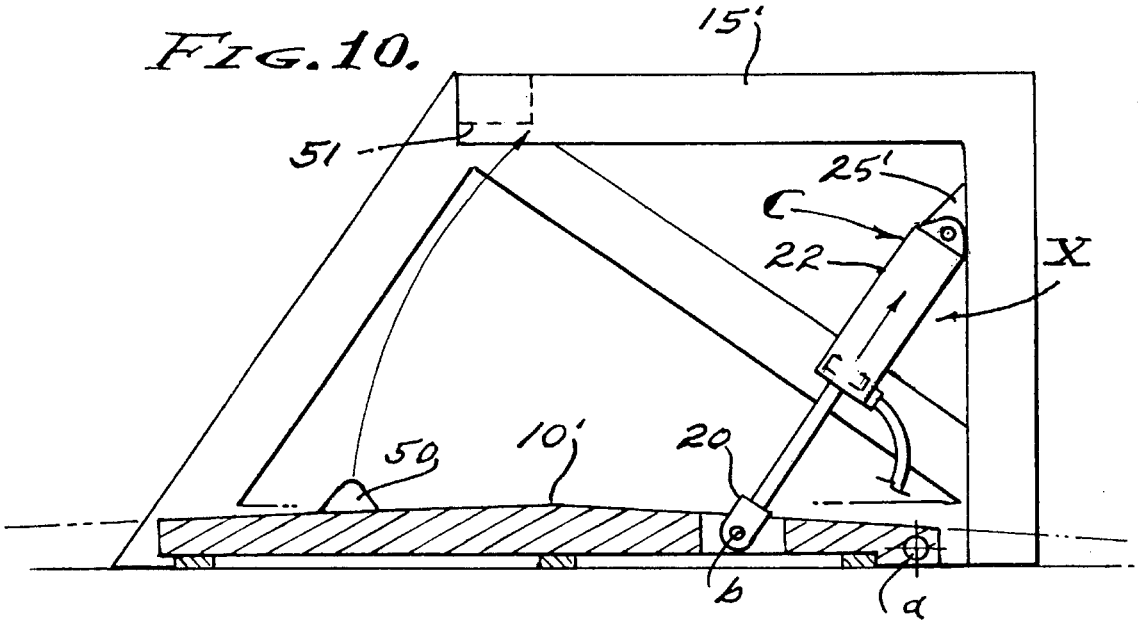

GAS PRE-CHARGED MASS COUNTERBALANCING

BACKGROUND OF THE INVENTION

This invention relates to elevating apparatus subject to the repeated operation of rapidly lifting a large retractile mass, it being a general object of this invention to levitate the mass so that elevating the mass is subject mainly to its inertia only, the gravitational effect on the mass being counterbalanced, and to facilitate moving the mass automatically to raise or lower the same as may be required.

Heretofore, it has been common practice to counterbalance structures and various mechanical apparatus such as elevators, cranes draw-bridges, barrier gates and the like, with springs and weights of equal and often greater mass, depending upon the leverage employed. This increased in mass is a great disadvantage when considering the use of space, the cost of augmenting the apparatus, and its operation and most important: its inherently retarded acceleration capability. Accordingly, it is an object of this invention to minimize the increase mass associated with a counterbalanced member that is adapted to be rapidly elevated.

The lifting of a mass is accomplished in various ways, among which is block and tackle or the equivalent cable lift as used in a passenger elevator, or a lever system, or a hydraulic ram system etc. A preferred lifting means as it is disclosed herein is a pneumatic cylinder and piston and compressed air supply system, whereby stored energy is made available for repeated cycles of operation in the event of a power supply failure, and a system that is readily recharged and adapted to rapid operation. It is an object of this invention to implement a pneumatic lift means in combination with a fluid-pneumatic and preferably a hydro-pneumatic mass counterbalancing means that counteracts gravitational forces on the mass, whereby inertia and friction only are involved.

The fluid-pneumatic or hydro-pneumatic mass lifting system herein disclosed has its advantageous application in trafficway barriers installed at points of vehicle ingress into highly sensitive areas of the Government and Military etc. For example, a typical barrier member that is required to be lifted from road level to a height of approximately three feet, must do so within one second (normally 4 to 6 seconds). Also a usual requirement is that the system must complete multiple cycles of operation without the application of outside power. A usual barrier member has a mass of about 6000 lbs. and requires about 180,000 inch lbs. of torque for satisfactory acceleration. It will be seen therefore, that it is extremely advantageous to minimize any additional mass such as a counterbalance attached to moving members of the mass to be accelerated upwardly. It is therefore a primary object of this invention to provide counterbalancing means in the form of a pneumatic spring that is adjustable to counteract gravitational force on the mass, whereby inertia and friction thereof is all that remains to be overcome when accelerating the mass upwardly or vertically.

It is an object of this invention to provide a counterbalancing system, especially adapted to a trafficway barrier mass, and a system that is automatic in its ability to either lift or lower the barrier mass, as circumstances may require. As will be described, there is an adjustable force exerting means for selectively opposing gravitational force on the mass, and adjustment to exact equilibrium is one possible condition that can be attained. However, it may be required that the mass be either automatically lowered or raised in the event of a power failure or like emergency. The condition of equilibrium requires applying a lifting force equal to weight of the mass, in which case the mass is said to be floating. When in a floating condition, the up or down positions are maintained in one of two ways, either by lifting means operation or by a releasable latch means; the lifting means operating to apply lift pressure, or the latch to apply a positive lock. By one fluid pressure adjustment to the force exerting means, a sinking condition is established for automatic closing down of the barrier mass, such as in the event of lifting means failure or when the up position latch is released. By another fluid pressure adjustment to the force exerting means, a lifting condition is established for automatic raising up of the barrier: mass, again such as in the event of lifting means failure or when the down position latch is released.

SUMMARY OF THE INVENTION

From the foregoing background, it will be seen that counterbalancing of a large mass is to be accomplished with an adjustable pneumatic spring means that counteracts the gravitational effect on said mass. Only the mass inertia remains to be accelerated upwardly. As shown, herein, the mass swings upwardly about a pivotal axis.

In accordance with this invention, heavy counterbalances are eliminated whereby extra moving masses are nonexistent. This minimizes mass and is conducive to faster acceleration and reduced cost of construction and operation as well. Reduced weight also increases the available number of cycles of operation, since less energy is required to lift the mass. A feature of this invention is the simplicity of the design, in that a single acting cylinder and piston means is employed for counterbalancing. However, it is to be understood that this does not preclude the use of double acting cylinder and piston means to levitate the mass disposed in or near equilibrium by this pneumatic counterbalancing means. As stated above, there is one of several conditions of the mass which will be a requirement for a particular system installation. That is, it may be required that the mass be in exact equilibrium at a certain position. Or it may be required that the mass will automatically descend when the lifting means fails or the latch is released. Or it may be required that the mass will automatically rise when the lifting means fails or the latch is released. In accordance with this invention, the force exerting counterbalancing system as it is disclosed, performs any one of these requirements by adjustment thereto as circumstances may require. Adjustment is between an underbalanced and an overbalanced condition.

The foregoing and various other objects and features of this invention will be apparent and fully understood from the following detailed description of the typical preferred forms and applications thereof, throughout which description reference is made to the accompanying drawings.

THE DRAWINGS

Figure 2A:
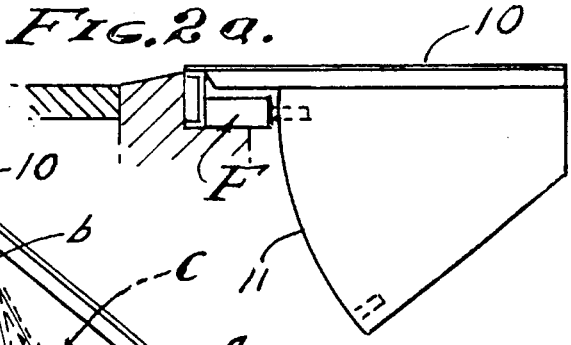
FIG. 2 is a sectional view taken substantially as indicated by line 2—2 on FIG. 1.
Figure 2:
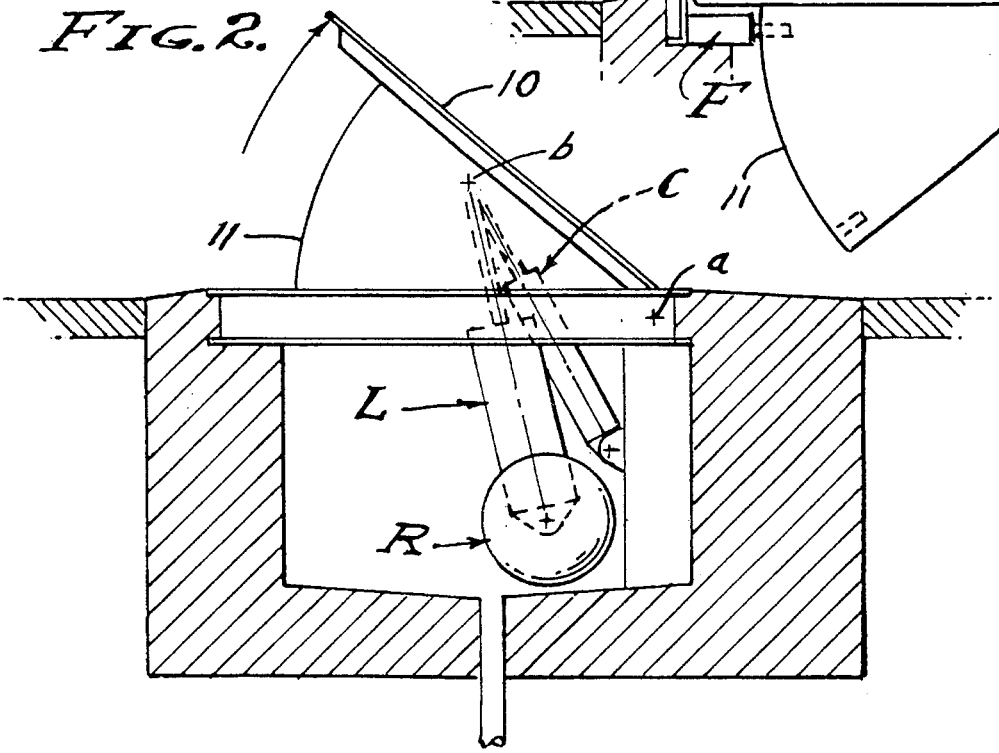

FIG. 2*a* is a fragmentary view of a portion of FIG. 2, illustrating a latch means that secures the barrier mass in an up or down position.

Figure 3:
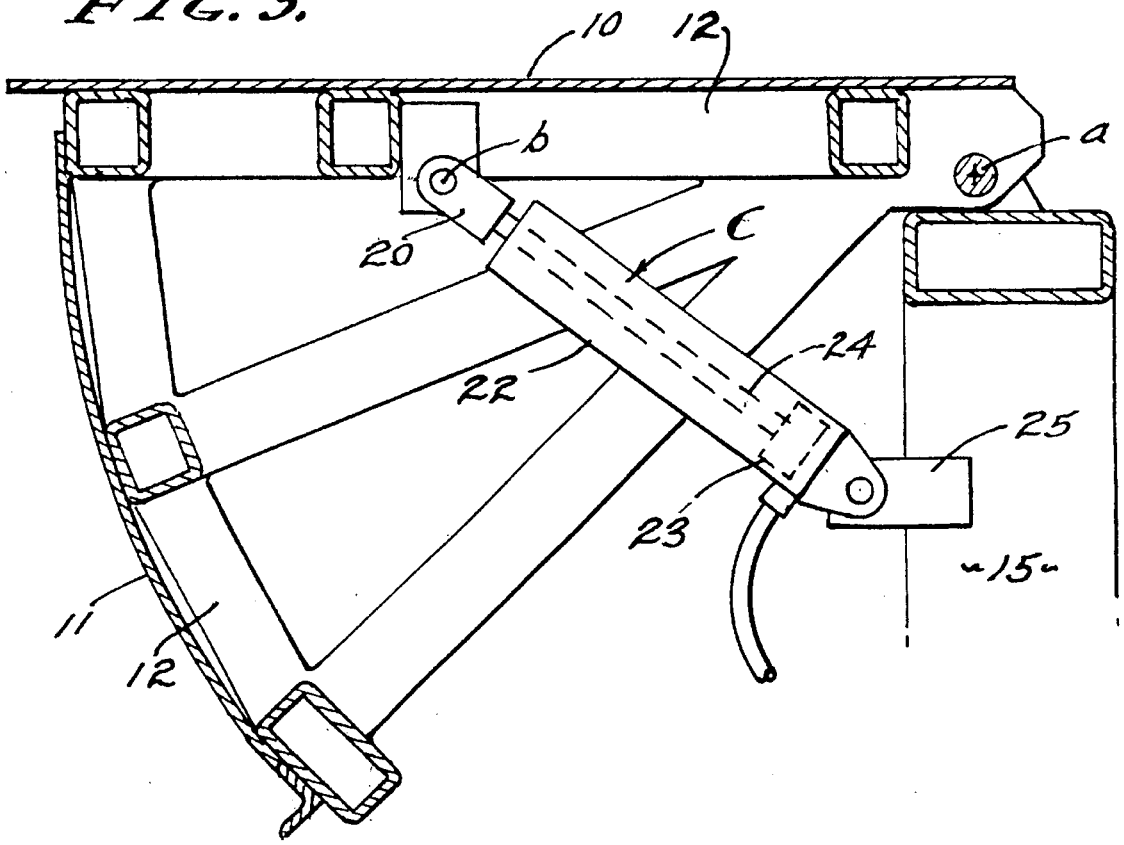

FIG. 3 is an enlarged detailed sectional view of the barrier per se, and showing the counterbalancing cylinder and piston means in a down position.

Figure 4:
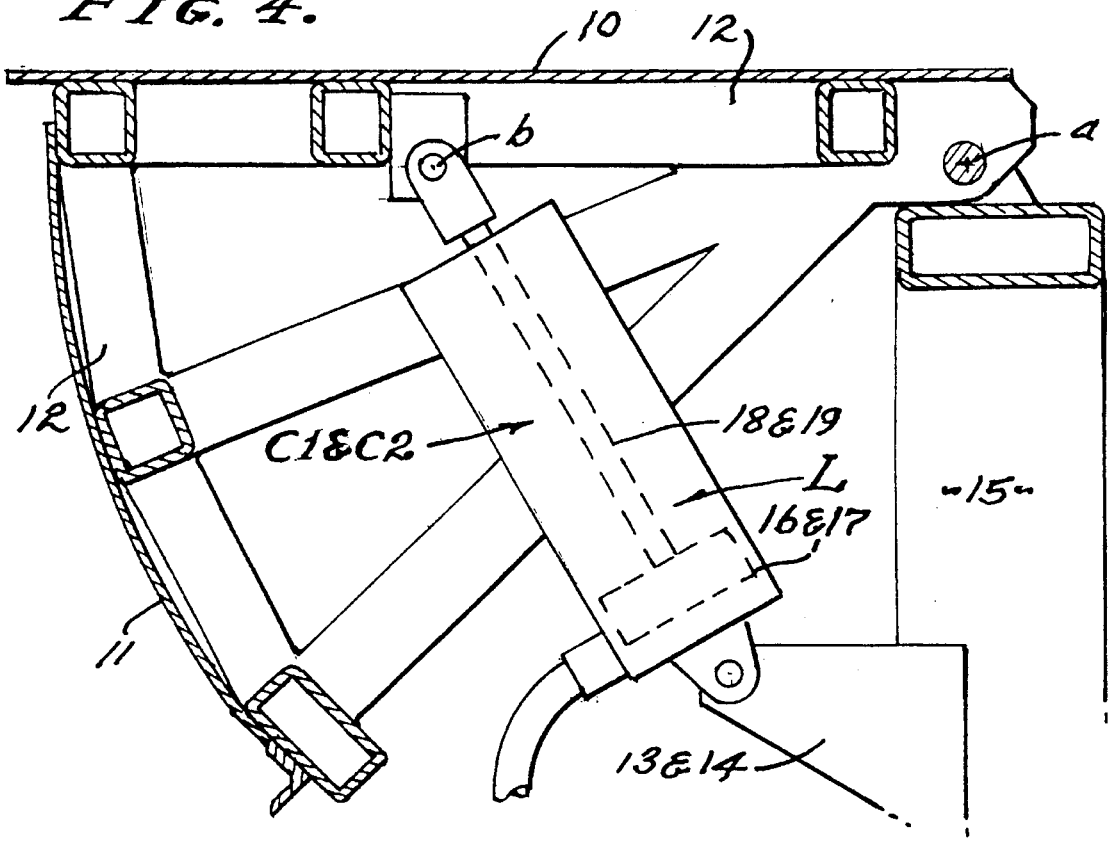

FIG. 4 is an enlarged detailed sectional view of the barrier per se, and showing the lifting cylinder and piston means in a down position.

Figure 5:
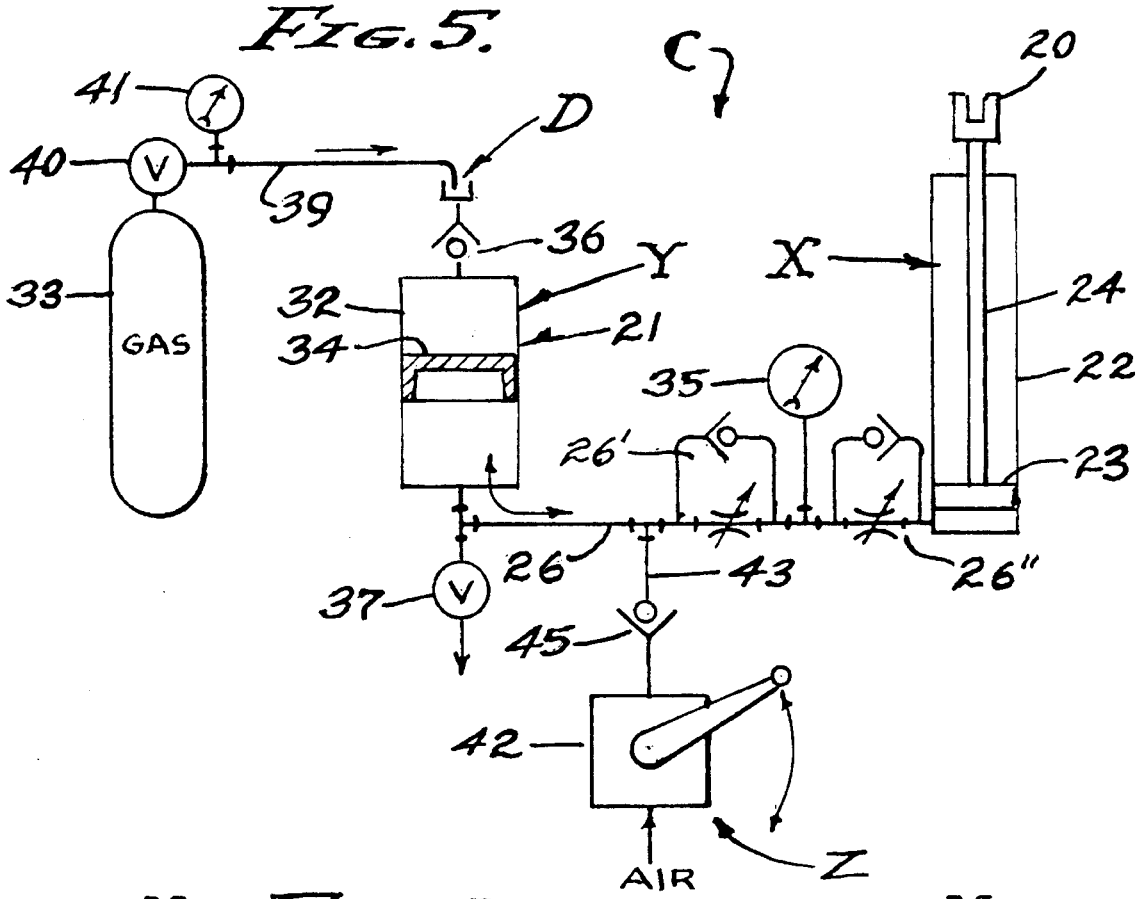

FIG. 5 is a schematic diagram of the basic fluid-pneumatic counterbalancing system wherein gas (air) is the working fluid.

Figure 6:
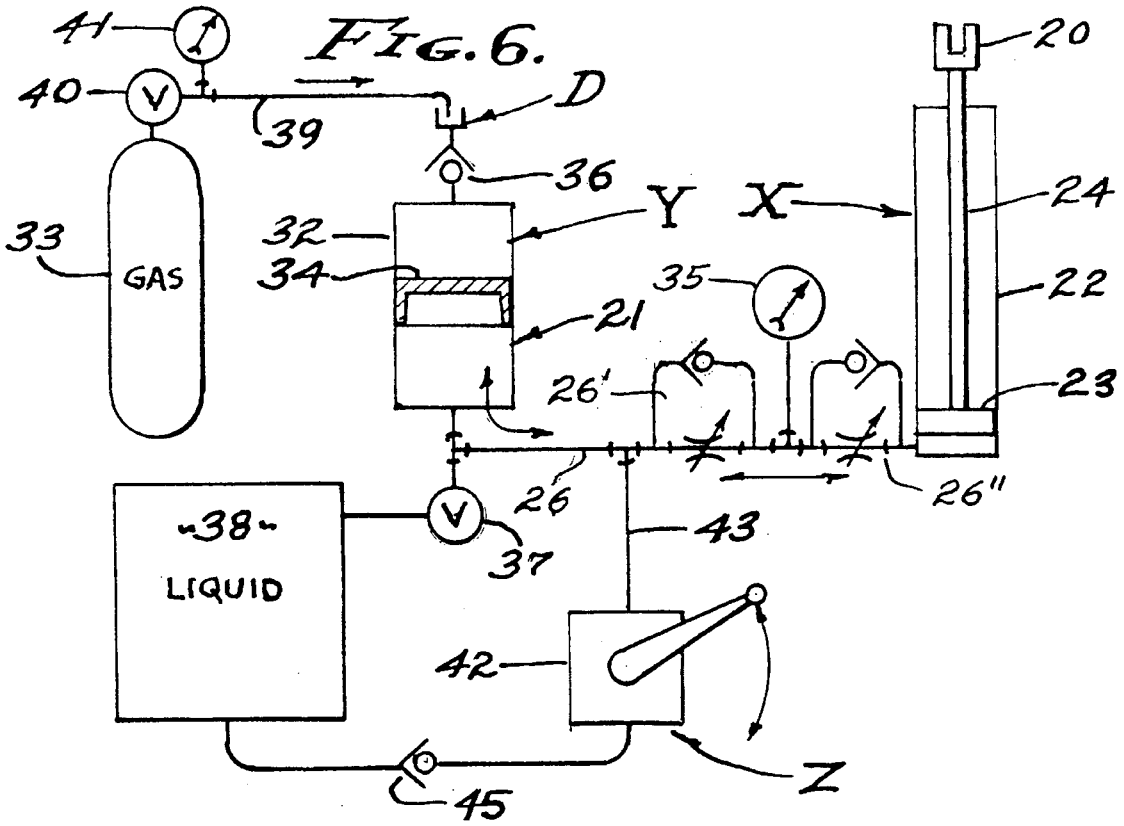

FIG. 6 is a schematic diagram similar to FIG. 5, of the preferred hydro-pneumatic counterbalancing system wherein liquid is the working fluid.

Figure 7:
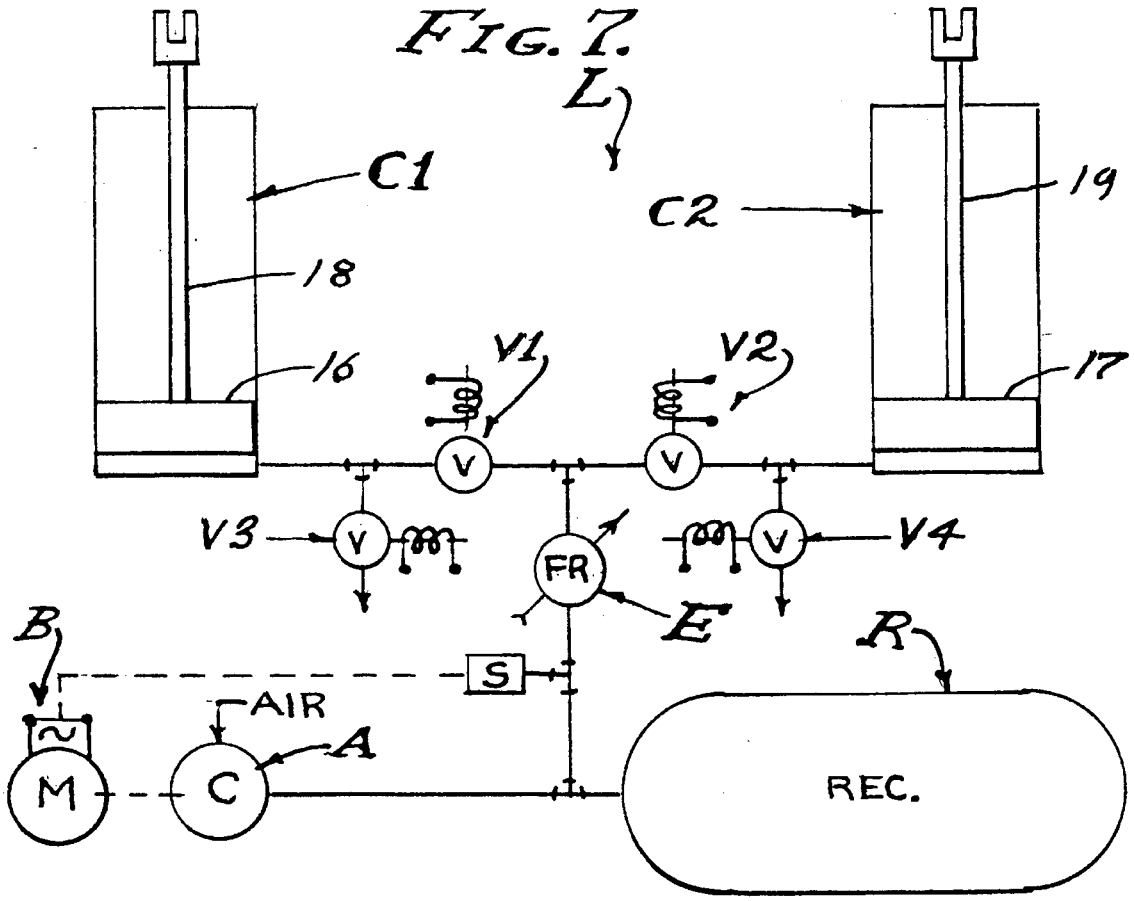

FIG. 7 is a schematic diagram of the pneumatic lifting system as it is employed in the trafficway barrier shown and described.

Figure 8:
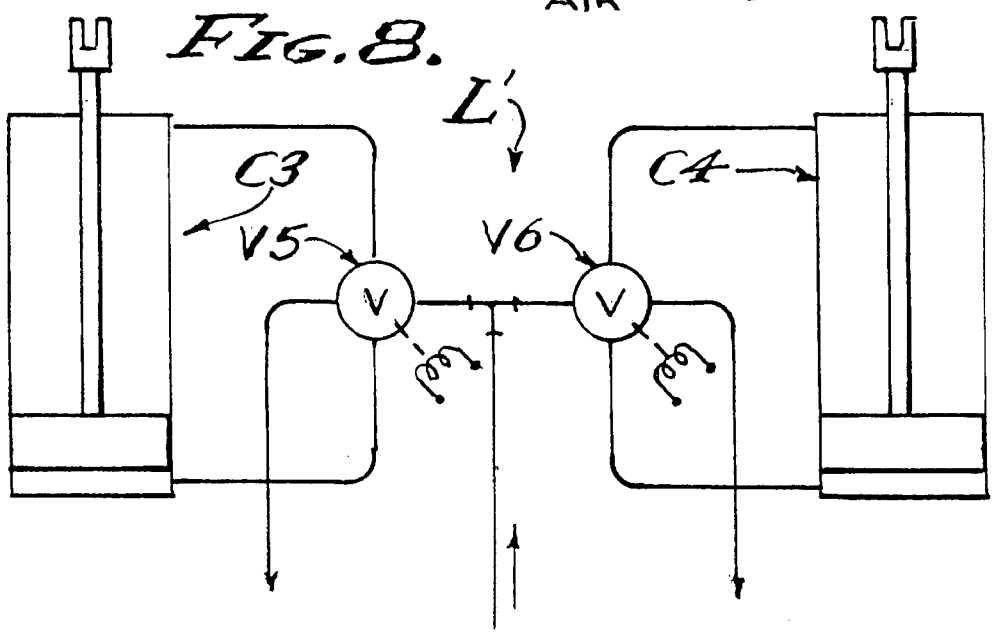

FIG. 8 is a schematic diagram similar to FIG. 7, and shows a double acting cylinder and piston embodiment of the pneumatic lifting system.

FIG. 9 is a perspective view of a surface mounted trafficway barrier, wherein the entire structure and counterbalancing system is installed above grade.

And, FIG. 10 is an enlarged sectional view taken as indicated by line 10—10 on FIG. 9, showing the barrier plate 10' in a depressed position.

PREFERRED EMBODIMENT

Figure 1:
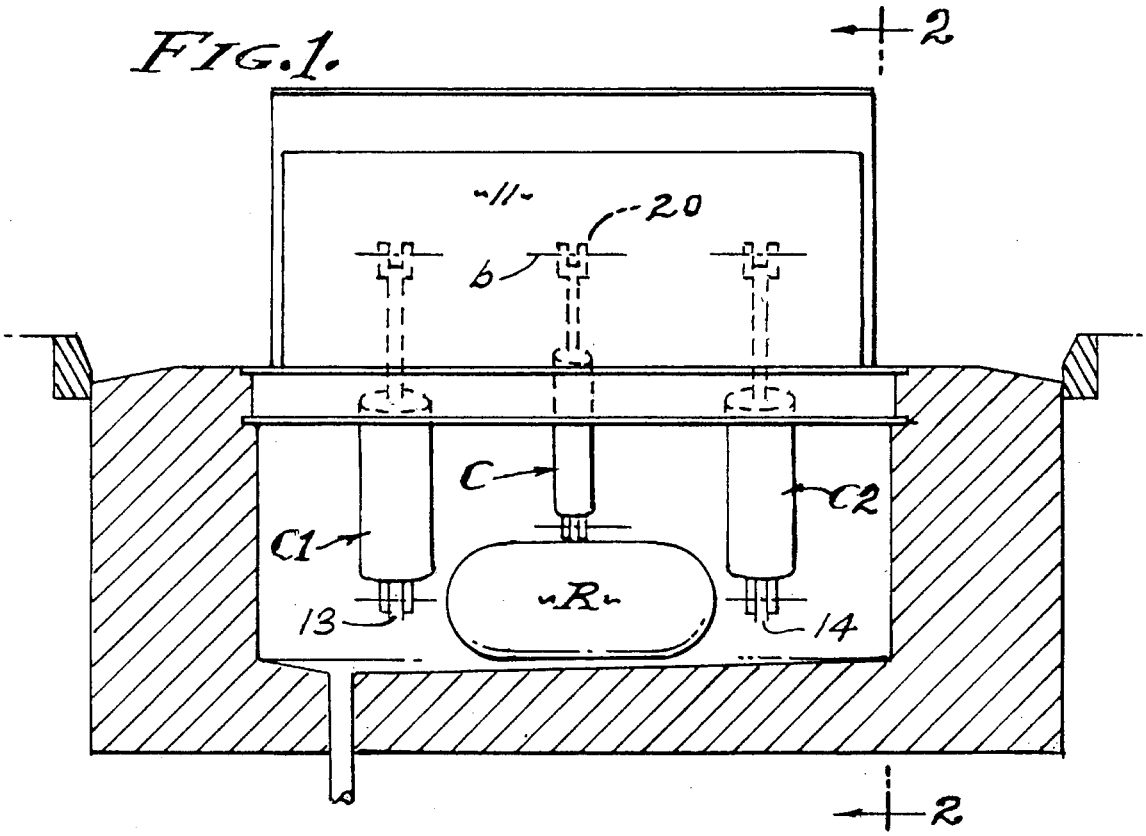
FIG. 1 is a transverse sectional view taken through a typical trafficway barrier installation, showing the implimentation of the mass counterbalancing system of the present invention, and with the barrier elevated.

The fluid-pneumatic or hydro-pneumatic mass counterbalancing system is disclosed herein as it is applied to a trafficway barrier employed to control unauthorized vehicular ingress to sensitive areas. Barriers of the type under consideration are heavily constructed and are subjected to rigorous operation, and often under adverse conditions. For example, repeated cycles of operation may be required without the availability of a power source. Also, rapid operation is a normal requirement, regardless of the heavy mass that is lifted into a traffic blocking position. As shown, the trafficway barrier is a heavy steel structure that is retractile to the trafficway surface and characterized by a surface plate 10 pivoted on an axis a and adapted to swing upward approximately 45° to a traffic blocking position (see FIGS. 1 and 2). A typical barrier for controlling a single lane of vehicular traffic involves a mass of approximately 6000 lbs. and it is normally required that it be raised to full height in 1 to 4 seconds, depending upon the emergency that could be involved. Control of the barrier can be manual or automated and involves a mechanical lifting mechanism that raises and lowers the plate 10 as required.

As disclosed herein, a lifting means is fluid operated and preferably a pneumatic lift capable of multiple cycles of operation on stored energy (compressed air). The barrier is surface mounted and comprised of a flat top plate 10 that swings upward from the plane of the trafficway and to the aforementioned 45° position, there being a semi-cylindrical wall 11 concentric with the axis a. The wall 11 is a heavy steel wall to withstand vehicular impact and it is supported by a trussed frame 12 pivoted on the axis a and to which the top plate 10 and the wall 11 are replaceably attached. The plate 10, wall 11 and support frame 12 constitute the moveable mass that is raised and lowered by the lifting means L and which is counterbalanced by the hydro-pneumatic counterbalancing means C herein disclosed.

The lifting means L can vary as required, motor driven or fluid driven as shown, and preferably a pneumatic lifting means whereby compressed air for the required number of operational cycles is stored in a receiver R. Accordingly, there is an air compressor A that charges the receiver R with compressed air sensed by a pressure responsive switch S to operate a controller B to electrically power the motor M of the compressor A. Compressed receiver air is available through an adjustable flow control means E to solenoid valves V1 and V2 for actuating lift cylinders C1 and C2. In practice, there are spaced pneumatic cylinders C1 and C2 pivoted from fixed hangers 113 and 14 secured to a base 15 that carries the axis a placed at the plane of the trafficway. The cylinders C1 and C2 are single acting with pistons 16 and 17 lifted by air pressure when valves V1 and V2 are opened, to project piston rods 18 and 19 upwardly and coupled to the plate 10 by a pivoted clevis or the like to lift the same. When valves V1 and V2 are closed the air charges are individually captured in the cylinders C1 and C2 to hold the lifted positions of the pistons 16 and 17. Solenoid dump valves V3 and V4 are provided to release the compressed air charges from the cylinders C1 and C2, whereby gravity will lower the barrier plate 10 and wall 11. It is to be understood that the controlling solenoid valves V1 and V2 or V3 and V4 are alternately operated simultaneously by a control means (not shown). The pressure sensing switch S is set to the desired operating pressure for acceleration of the barrier mass, and the flow control means E is adjusted to determine the rate of acceleration.

A feature of this invention is the inherent automatic raising and lowering of the barrier mass as circumstances require, and all of which is accomplished by the one and the same system. That is and according to either requirement, the force exerting means X that counterbalances the barrier mass against gravity is adjusted to establish either a sinking or a raised condition of the barrier mass, for example when in a level position. When the force exerting means X, next described, is adjusted to exert a pressure or force less than equilibrium, a sinking condition is established whereby the barrier mass automatically sinks to a down position when the lifting force of the means L or L' is removed, whether deliberately or by malfunction. And alternately, when force exerting means X is adjusted to exert a pressure or force greater than equilibrium, a lifting condition is established whereby the barrier mass automatically raises to an up position when a downward force or locked position is released. This latter condition for automatic raising of the barrier mass requires at least one of the following means or features:

When the lifting force exerted by the means X is greater than equilibrium, the barrier mass must be held down, as by either a double acting cylinder and piston means C3 and C4 or the like (see FIG. 8), or by a latch F (see FIG. 2*a*).

Referring now to FIG. 8 of the drawings, the double acting cylinder and piston means C3 and C4 are activated by solenoid valves V5 and V6 to retract the pistons 16 and 17 to down positions and thereby hold the barrier mass and plate 10 in a down position against the lifting force of the force exerting means X. If and when the retraction force of the double acting means L' is released or fails, the barrier is then automatically raised by the force exerting means X. Referring to FIG. 2*a*, release of the latch F produces the same effect, releasing the barrier mass so that it is automatically raised. It is significant that this counterbalancing system involves infinitely variable underbalanced sinking conditions and infinitely variable overbalanced lifting conditions. Also, it is to be observed that the balancing force diminishes as the means X is protracted.

Referring now to FIG. 6 of the drawings, the pneumatic mass counterbalancing means C is a passive system that is adjusted to have a continuous force effect tending to lift the barrier mass to which it is coupled by a clevis at 20. As shown, the clevis 20 is on an axis b coincidental with the spaced clevis axes of the lift cylinders C1 and C2, the axes b being spaced radially from the axis a so that the frame 12 forms a lever for lifting the top plate 10. In accordance with this invention, the counterbalancing means C is comprised generally of a force exerting means X, a pressure supply means Y, and a pressure adjustment means Z. A feature of this counterbalancing means C is that it is pneumatic wherein a lifting force is exerted by liquid pressure and the pressure is pre-charged pneumatically. It is the compressibility of an elastic medium that is provided in the form of a pre-charge of gas, preferably dry nitrogen applied by the supply means Y in the form of a pressure accumulator 21, into which working fluid (liquid) is pumped by the adjustment means Z.

It is significant that the pressure accumulator 21 is pre-charged with gas that supports the barrier mass and filled with a volume of fluid that will ensure a full lifting stroke of the force exerting means X. In practice, gas or hydraulic fluid is pumped by the adjustment means Z into the force means X and supply means Y in order to adjustably increase the gas pre-charge in the supply means Y until the lifting force exerted by the means X substantially equals the weight of the barrier mass. The coupling axis b is at or near, and beneath, the center of gravity of said mass. Accordingly, the barrier mass becomes essentially weightless, with the means Z adjusted to a condition of equilibrium, from which the means Z is adjustable to an underbalanced sinking condition, or to an overbalanced lifting condition. These underbalanced and overbalanced conditions enable automatic raising and lowering of the barrier mass.

Referring now to the force exerting means X, a cylinder 22 and piston 23 with an extensible rod 24 connected to the clevis 20 is preferred. As shown, the cylinder and piston force exerting means X is single acting with its cap end pivoted on a fixed hanger 25 secured to the base 15. A single gas or hydraulic line 26 opens into the cap end of the cylinder 22 beneath the piston 23, there being; adjustable in and out flow restrictors 26' and 26" to control the response of means X.

Referring now to the pressure supply means Y, a cylinder 32 and floating piston 34 gas pressured hydro-accumulator 21 is preferred. The lower gas or hydraulic end of the cylinder 32 is open to the line 26, there being a pressure gage 35 in said line for determining the line pressure for adjustment of the force exertion applied by the means X. A feature of the pressure supply means Y is the pre-charge means D and check valve 36 that opens into the upper gas charging end of the cylinder 32, for pre-charging the accumulator 21.

Referring now to the pre-charging of the accumulator 201, the pressure of the pre-charge will vary with the particular mass of each barrier counterbalanced thereby. In carrying out this invention, the pre-charge is applied when working fluid pressure is released from line 26. Accordingly, there is a dump valve 37, to atmosphere for gas working fluid, and into a reservoir 38 to release hydraulic working fluid, and whereby an exact pre-charge can be established when the valve. 37 is opened. In accordance with this invention, the pre-charge is when the free-floating piston 34 is at the bottom of the stroke which minimizes the volume when using hydraulic fluid in the accumulator cylinder 32, and maximizes the volume of gas that can be charged therein. The gas accumulator 21 is then pre-charged from a gas bottle 33 or the like, with dry-Nitrogen through a charging line 39 and the pre-charge means D under control of a charging valve 40, there being a pressure gage 41 in said charging line for determining the pre-charge pressure. The gas bottle 33 and charging line 39 can remain connected to the charge means P or removed therefrom as circumstances require.

Referring now the preferred hydro-pneumatic embodiment shown in FIG. 6, and the pressure adjustment means Z, a pump 42 in a pressure line 43 from the reservoir 38 supplies hydraulic pressure to the line 26, in order to charge the hydraulic end of the accumulator 21 with a volume of fluid to ensure a full stroke operation of the cylinder 22 and piston 23 of the force exerting means X. The introduction of hydraulic fluid into the pre-charged accumulator 21 increases the pre-charged gas pressure therein, commensurate with the force to be applied by the force exerting means X, until near equilibrium is attained with said minimum down force applied for ensuring descent of the barrier mass. A manual pump 42 is employed with an operating lever 44, there being a check valve 45 that holds the line pressure in lines 43 and 26. The dump valve 37 is employed to release said hold of pressure that passively sustains the force that variably exerts counterbalancing pressure that renders the barrier mass substantially weightless.

Referring now to the basic fluid-pneumatic embodiment of FIG. 5, the pressure adjustment means Z is essentially the same as hereinabove described, a pump 42 in a gas fluid line 43, eliminating the reservoir 38, supplies gas fluid pressure to the line 26, in order to charge the working fluid end of the accumulator 21 with a volume of gas fluid to ensure a full stroke operation of the cylinder 22 and piston 23 of the force exerting means X. The introduction of working gas fluid into the pre-charged accumulator 21 increases the pre-charged gas pressure therein, commensurate with the force to be applied by the force exerting means X, until near equilibrium is attained with said minimum down force applied for ensuring descent of the barrier mass. A manual air pump 42 is employed with an operating lever 44, there being a check valve 45 that holds the line pressure in lines 43 and 26. The dump valve 37 is employed to release said hold of working air fluid pressure that passively sustains the force that adjustably exerts counterbalancing pressure that renders the barrier mass substantially weightless.

The piston rod 24 is extensible and retractable to apply diminishing force to the clevis 20 coupled to the barrier mass, whereby gravitational force is available at the raised position in order to initiate downward movement of the barrier, and the lifting force of the force exerting means X increasing to its original pre-set condition when the barrier is in its do position at the plane of the trafficway. It is advantageous that the force exerted by the means X is depleted by extension of the cylinder and piston rod 24, and that said force is restored by the gravitational force reapplied by the descending barrier mass.

Referring now to FIGS. 9 and 10 of the drawings, a surface mounted embodiment implementing the counterbalancing force exerting means X is shown, wherein the entire installation is above grade. This is a significant embodiment, since many trafficway barrier installations are upon decks and roof structures of buildings and the like; for example complex entries and garages. Accordingly, the barrier plate 10' is lifted by the counterbalancing means C from above, the coupling axis b being on top of the plate 10' and the hanger 25' being fixed to a frame 15' that is erected at either side of the trafficway, as clearly illustrated in FIG. 9. That is, there are two frame structures 15', one at each side of the trafficway, supported upon the shoulder portions of said trafficway, and the cylinder 22 is pivoted to the hanger 25' positioned above the barrier. The couplings 20 are positioned at each side of the plate 10. A feature of this embodiment is the hooked engagement of the plate 10' when in a raised position, by means of lugs 50 at the corners of the plate 10'. The lugs 50 engage into downwardly open notches 51 in the top of the frame 15' for hooked engagement to prevent separation of the frames and deflections in the structure when subjected to high impact forces. Lifting cylinders C1 and C2 are installed alongside the aforesaid cylinder 22 of means C, and all of which operates as above described.

Having described only the preferred forms and applications of my invention, I do not wish to be limited or restricted to the specific details herein set forth, but wish to reserve to myself any modifications or variations that may appear to those skilled in the art as set forth within the limits of the following claims.

I claim:

1. A fluid-pneumatic counterbalancing system adjustably applying lifting force to a mass adapted to be raised by a lift means overcoming inertia of said lass, and including;

a fluid force exerting means coupled to the mass for opposing gravitational force of said mass, a fluid-pneumatic pressure supply means for applying fluid pressure to said force exerting means, a pneumatic pre-charge means for charging the fluid-pneumatic pressure supply means with a pre-set gas pressure, and an adjustment means for charging the fluid-pneumatic pressure supply means with working fluid to ensure full operation of the force exerting means, the pre-set gas pressure being increased by said charging the fluid-pneumatic pressure supply means with working fluid to apply working fluid pressure for adjustably counterbalancing the mass above and below its gravitational weight.

2. The fluid-pneumatic counterbalancing system as set forth in claim 1, wherein the working fluid is air compressed by the adjustment means.

3. The fluid-pneumatic counterbalancing system as set forth in claim 1, wherein the fluid-pneumatic pressure supply means is a gas pressured gas accumulator having a gas charged end and a working fluid end open into the fluid force exerting means.

4. The fluid-pneumatic counterbalancing system as set forth in claim 1, wherein the fluid force exerting means is a cylinder and piston with an extensible rod for raising a clevis coupled to the mass, and wherein the fluid-pneumatic pressure supply means is a gas pressured gas accumulator having a gas charged end and a working fluid end open into the cylinder of the fluid force exerting means.

5. The fluid-pneumatic counterbalancing system as set forth in claim 1, wherein the pneumatic pre-charge means is a check valve in a line from a gas pressure source and into a pneumatic end of the fluid-pneumatic pressure supply means.

6. The fluid-pneumatic counterbalancing system as set forth in claim 1, wherein the fluid-pneumatic pressure supply means is a gas pressured gas accumulator having a gas charged end and a working gas end open into the fluid force exerting means, and wherein the pneumatic pre-charge means is a check valve in a line from a gas pressure source and into the gas charged end of the fluid-pneumatic pressure supply means.

7. The fluid-pneumatic counterbalancing system as set forth in claim 1, wherein the adjustment means is an air pump from atmosphere and into the fluid-pneumatic pressure supply means for applying working fluid pressure to said force exerting means, and adapted to increase fluid-pneumatic pressures as required.

8. The fluid-pneumatic counterbalancing system as set forth in claim 1, wherein the adjustment means is a manual hand operated air pump charging air into the fluid-pneumatic pressure supply means for applying working fluid pressure to said force exerting means, and adapted to increase fluid-pneumatic pressures as required.

9. The fluid-pneumatic counterbalancing system as set fourth in claim 1, wherein the fluid force exerting means is a cylinder and piston with an extensible rod for raising a clevis coupled to the mass, wherein the fluid-pneumatic pressure supply means is a gas pressured gas accumulator having a gas charged end and a working fluid end open into the cylinder of the hydraulic force exerting means, wherein the pneumatic pre-charge means is a check valve in a line from a gas pressure source and into the gas charged end of the fluid-pneumatic pressure supply means, and wherein the adjustment means is a manual hand operated air pump from atmosphere and charging into the fluid-pneumatic pressure supply means for applying working fluid pressure to said force exerting means, and adapted to increase fluid-pneumatic pressures as required.

10. The fluid-pneumatic counterbalancing system as set forth in claim 1, wherein the working fluid is air compressed by the adjustment means, and wherein the pre-set gas pressure is increased by charging the fluid-pneumatic pressure supply means with fluid to apply working fluid pressure underbalancing the mass below its gravitational weight, whereby the mass inherently sinks when released.

11. The fluid-pneumatic counterbalancing system as set forth in claim 1, wherein the working fluid is air compressed by the adjustment means, and wherein the pre-set gas pressure is increased by charging the fluid-pneumatic pressure supply means with fluid to apply working fluid pressure overbalancing the mass above its gravitational weight, whereby the mass inherently lifts when released.

12. A hydro-pneumatic counterbalancing system adjustably applying lifting force to a mass adapted to be raised by a lift means overcoming inertia of said mass, and including;

a hydraulic force exerting means coupled to the mass for opposing gravitational force of said mass, a hydro-pneumatic pressure supply means for applying hydraulic pressure to said force exerting means, a pneumatic pre-charge means for charging the hydro-pneumatic pressure supply means with a pre-set gas pressure, and an adjustment means for charging the hydro-pneumatic pressure supply means with hydraulic fluid to ensure full operation of the force exerting means, the pre-set gas pressure being increased by said charging the hydro-pneumatic pressure supply means with hydraulic fluid to apply hydraulic fluid pressure for adjustably counter-balancing the mass above and below its gravitational weight.

13. The hydro-pneumatic counterbalancing system as set forth in claim 12, wherein the hydraulic force exerting means is a cylinder and piston with an extensible rod for raising a clevis coupled to the mass.

14. The hydro-pneumatic counterbalancing system as set forth in claim 12, wherein the hydro-pneumatic pressure supply means is a gas pressured hydraulic accumulator having a gas charged end and a hydraulic end open into the hydraulic force exerting means.

15. The hydro-pneumatic counterbalancing system as set forth in claim 12, wherein the hydraulic force exerting means is a cylinder and piston with an extensible rod for raising a clevis coupled to the mass, and wherein the hydro-pneumatic pressure supply means is a gas pressured hydraulic accumulator having a gas charged end and a hydraulic end open into the cylinder of the hydraulic force exerting means.

16. The hydro-pneumatic counterbalancing system as set forth in claim 12, wherein the pneumatic pre-charge means is a check valve in a line from a gas pressure source and into a pneumatic end of the hydro-pneumatic pressure supply means.

17. The hydro-pneumatic counterbalancing system as set forth in claim 12, wherein the hydro-pneumatic pressure supply means is a gas pressured hydraulic accumulator having a gas charged end and a hydraulic end open into the hydraulic force exerting means, and wherein the pneumatic pre-charge means is a check valve in a line from a gas pressure source and into the gas charged end of the hydro-pneumatic pressure supply means.

18. The hydro-pneumatic counterbalancing system as set forth in claim 12, wherein the adjustment means is a hydraulic pump from a hydraulic fluid reservoir and into the hydro-pneumatic pressure supply means for applying hydraulic pressure to said force exerting means, and adapted to increase hydro-pneumatic pressures as required.

19. The hydro-pneumatic counterbalancing system as set forth in claim 12, wherein the adjustment means is a manual hand operated hydraulic pump from a hydraulic fluid reservoir and into the hydro-pneumatic pressure supply means for applying hydraulic pressure to said force exerting means, and adapted to increase hydro-pneumatic pressures as required.

20. The hydro-pneumatic counterbalancing system as set forth in claim 12, wherein the hydraulic force exerting means is a cylinder and piston with an extensible rod for raising a clevis coupled to the mass, and wherein the hydro-pneumatic pressure supply means is a gas pressured hydraulic accumulator having a gas charged end and a hydraulic end open into the cylinder of the hydraulic force exerting means, wherein the pneumatic pre-charge means is a check valve in a line from a gas pressure source and into the gas charged end of the hydro-pneumatic pressure supply means, and wherein the adjustment means is a manual hand operated hydraulic pump from a hydraulic fluid reservoir and into the hydro-pneumatic pressure supply means for applying hydraulic pressure to said force exerting means, and adapted to increase hydro-pneumatic pressures as required.

21. The hydro-pneumatic counterbalancing system as set forth in claim 12, wherein the working fluid is a hydraulic fluid, and wherein the pre-set gas pressure is increased by charging the hydro-pneumatic pressure supply means with hydraulic fluid to apply hydraulic fluid pressure underbalancing the mass below its gravitational weight, whereby the mass inherently sinks when released.

22. The hydro-pneumatic counterbalancing system as set forth in claim 12, wherein the working fluid is a hydraulic fluid, and wherein the pre-set gas pressure is increase by charging the hydro-pneumatic pressure supply means with hydraulic fluid to apply hydraulic fluid pressure overbalancing the mass above its gravitational weight, whereby the mass inherently lifts when released.

23. A hydro-pneumatic counterbalancing system adjustably applying lifting force to a trafficway barrier mass adapted to be raised to an up extended position by a lift means overcoming inertia of said barrier mass, and including;

a hydraulic force exerting means coupled to the barrier mass for opposing gravitational force of said barrier mass, a hydro-pneumatic pressure supply means for applying hydraulic pressure to said force exerting means, a pneumatic pre-charge means for charging the hydro-pneumatic pressure supply means with a pre-set gas pressure, and an adjustment means for charging the hydro-pneumatic pressure supply means with hydraulic fluid to ensure full operation of the force exerting means, the pre-set gas pressure being increased by said charging the hydro-pneumatic pressure supply means with hydraulic fluid to apply hydraulic fluid pressure for adjustably counterbalancing the barrier mass above and below its gravitational weight.

24. The hydro-pneumatic counterbalancing system for a trafficway barrier as set forth in claim 23, wherein the hydraulic force exerting means is a cylinder and piston with an extensible rod for raising a clevis coupled to the barrier mass.

25. The hydro-pneumatic counterbalancing system for a trafficway barrier as set forth in claim 23, wherein the hydro-pneumatic pressure supply means is a gas pressured hydraulic accumulator having a gas charged end and a hydraulic end open into the hydraulic force exerting means.

26. The hydro-pneumatic counterbalancing system for a trafficway barrier as set forth in claim 23, wherein the hydraulic force exerting means is a cylinder and piston with an extensible rod for raising a clevis coupled to the barrier mass, and wherein the hydro-pneumatic pressure supply means is a gas pressured hydraulic accumulator having a gas charged end and a hydraulic end open into the cylinder of the hydraulic force exerting means.

27. The hydro-pneumatic counterbalancing system for a trafficway barrier as set forth in claim 23, wherein the pneumatic pre-charge means is a check valve in a line from a gas pressure source and into a pneumatic end of the hydro-pneumatic pressure supply means.

28. The hydro-pneumatic counterbalancing system for a trafficway barrier as set forth in claim 23, wherein the hydro-pneumatic pressure supply means is a gas pressured hydraulic accumulator having a gas charged end and a hydraulic end open into the hydraulic force exerting means, and wherein the pneumatic pre-charge means is a check valve in a line from a gas pressure source and into the gas charged end of the hydro-pneumatic pressure supply means.

29. The hydro-pneumatic counterbalancing system for a trafficway barrier as set forth in claim 23, wherein the adjustment means is a hydraulic pump from a hydraulic fluid reservoir and into the hydro-pneumatic pressure supply means for applying hydraulic pressure to said force exerting means, and adapted to increase hydro-pneumatic pressures as required.

30. The hydro-pneumatic counterbalancing system for a trafficway barrier as set forth in claim 23, wherein the adjustment means is a manual hand operated hydraulic pump from a hydraulic fluid reservoir and into the hydro-pneumatic pressure supply means for applying hydraulic pressure to said force exerting means, and adapted to increase hydro-pneumatic pressures as required.

31. The hydro-pneumatic counterbalancing system for a trafficway barrier as set forth in claim 23, wherein the hydraulic force exerting means is a cylinder and piston with an extensible rod for raising a clevis coupled to the barrier mass, and wherein the hydro-pneumatic pressure supply means is a gas pressured hydraulic accumulator having a gas charged end and a hydraulic end open into the cylinder of the hydraulic force exerting means, wherein the pneumatic pre-charge means is a check valve in a line from a gas pressure source and into the gas charged end of the hydro-pneumatic pressure supply means, and wherein the adjustment means is a manual hand operated hydraulic pump from a fluid reservoir and into the hydro-pneumatic pressure supply means for applying hydraulic pressure to said force exerting means, and adapted to increase hydro-pneumatic pressures as required.

32. The hydro-pneumatic counterbalancing system for a trafficway barrier as set forth in claim 23, wherein the working fluid is a hydraulic fluid, and wherein the pre-set gas pressure is increased by charging the hydro-pneumatic pressure supply means with hydraulic fluid to apply hydraulic fluid pressure underbalancing the barrier mass below its gravitational weight, whereby the barrier mass inherently sinks when released.

33. The hydro-pneumatic counterbalancing system for a trafficway barrier as set forth in claim 23, wherein the working fluid is a hydraulic fluid, and wherein the pre-set gas pressure is increased by charging the hydro-pneumatic pressure supply means with hydraulic fluid to apply hydraulic fluid pressure overbalancing the barrier mass above its gravitational weight, whereby the barrier mass inherently lifts when released.

* * * * *